United States Patent [19]

Osborn et al.

[11] Patent Number: 4,632,169

[45] Date of Patent: Dec. 30, 1986

[54] TWO CYCLE CYLINDER BLOCK FOAM PATTERN

[75] Inventors: Harold L. Osborn, Winthrop Harbor; Roger B. Whipple, Waukegan, both of Ill.

[73] Assignee: Outboard Marine Corporation, Waukegan, Ill.

[21] Appl. No.: 729,522

[22] Filed: May 1, 1985

[51] Int. Cl.[4] ..... B22C 7/02

[52] U.S. Cl. ..... 164/45; 164/34; 164/235

[58] Field of Search ..... 164/34, 35, 36, 45, 164/235, 246, 249; 123/65 R

[56] References Cited

U.S. PATENT DOCUMENTS

| | | | |
|---|---|---|---|
| 3,459,253 | 8/1969 | Woolcott | 164/36 |
| 3,858,562 | 1/1975 | Lanpheer | 123/65 R |
| 3,938,481 | 2/1976 | Morton | 123/65 R |
| 4,026,254 | 5/1977 | Ehrlich | 123/65 R |
| 4,093,018 | 6/1978 | Trumbauer | 164/34 |
| 4,176,650 | 12/1979 | Noguchi et al. | 123/65 R |
| 4,190,093 | 2/1980 | Kearney | 164/45 |
| 4,197,899 | 4/1980 | Ernest | 164/45 |
| 4,328,770 | 5/1982 | Hale | 123/59 B |
| 4,462,453 | 7/1984 | Trumbauer | 164/36 |

*Primary Examiner*—Nicholas P. Godici
*Assistant Examiner*—Richard K. Seidel
*Attorney, Agent, or Firm*—Michael, Best & Friedrich

[57] ABSTRACT

A foam mold pattern for making an engine block in a lost foam casting process, the pattern comprising an upper portion including a cylinder bore upper portion, and an upper portion of an exhaust port and an upper portion of an inlet port communicating with the cylinder bore upper portion, and a lower portion including a cylinder bore lower portion and being attached to the pattern upper portion such that the cylinder bore lower portion is aligned with the cylinder bore upper portion.

25 Claims, 9 Drawing Figures

TWO CYCLE CYLINDER BLOCK FOAM PATTERN

BACKGROUND OF THE INVENTION

The invention relates to methods and apparatus for metal casting, and more particularly to methods and apparatus for casting a two cycle cylinder block in a lost foam casting process. Even more particularly, the invention relates to foam patterns and methods for making foam patterns for casting a two cycle cylinder block in a lost foam casting process.

The casting of two cycle cylinder blocks has always been difficult, due to the many interior ports and passages. For example, a typical two cycle cylinder block includes a cylinder bore, an exhaust port and an inlet port communicating with the cylinder bore, an exhaust passage communicating with the exhaust port, a transfer passage communicating with the inlet port, and a water cooling passage. A loop scavenged cylinder block includes at least two inlet ports and transfer passages. Because of the complicated construction of two cycle cylinder blocks, complicated casting techniques have been required.

Lost foam casting uses a foam pattern having structure identical to the structure of the object to be cast. Foam patterns are typically fabricated by injection molding, and it can be appreciated by one skilled in the injection molding art that molding a foam pattern having the structure of a two cycle cylinder block would be a difficult task.

It is known in the lost foam casting art to form a foam pattern by gluing various pieces of a pattern together.

Attention is directed to the following United States patents which relate to casting with consumable patterns into casting of engine parts:

| | | |
|---|---|---|
| Trumbauer | 4,093,018 | June 6, 1978 |
| Hale | 4,328,770 | May 11, 1982 |
| Trumbauer | 4,462,453 | July 31, 1984 |
| Woolcott | 3,459,253 | August 5, 1969 |
| Kearney | 4,190,093 | February 26, 1980 |
| Ernest | 4,197,899 | April 15, 1980 |

SUMMARY OF THE INVENTION

The invention provides a foam mold pattern for making an engine block in a lost foam casting process, the pattern comprising a first portion including a cylinder wall defining a first portion of a cylinder bore, and a first portion of a port in the cylinder wall communicating with the cylinder bore, and a second portion including a second portion of the cylinder bore and being attached to the pattern first portion with the second portion of the cylinder bore in alignment with the first portion of the cylinder bore.

The invention also provides a foam mold pattern for making an engine block in a lost foam casting process, the pattern comprising an upper portion including a cylinder bore upper portion, an upper portion of an exhaust port communicating with the cylinder bore upper portion, and an upper portion of an inlet port communicating with the cylinder bore upper portion, a middle portion including a cylinder bore middle portion and being attached to the pattern upper portion such that the cylinder bore middle portion is aligned with the cylinder bore upper portion, and a lower portion including a cylinder bore lower portion and being attached to the pattern middle portion with the cylinder bore lower portion in alignment with the cylinder bore middle portion.

In one embodiment, the pattern middle portion further includes a lower portion of an exhaust port communicating with the cylinder bore middle portion and aligned with the exhaust port upper portion, and a lower portion of an inlet port communicating with the cylinder bore middle portion and aligned with the inlet port upper portion.

In one embodiment, the inlet port upper portion has an upper edge located in the pattern upper portion and is positioned radially opposite the exhaust port, the cylinder bore has an upper end, and the pattern further includes second and third inlet ports communicating with the cylinder bore and having upper portions located in the pattern upper portion and having upper edges equidistant from the upper end of the cylinder bore, the upper edge of the first-mentioned inlet port being spaced farther from the upper end of the cylinder bore than are the upper edges of the second and third inlet ports.

In one embodiment, each of the first-mentioned, second and third inlet ports also has a lower portion located in the pattern middle portion.

In one embodiment, the cylinder bore has a lower end, and the pattern further includes a portion of a crankcase communicating with the lower end of the cylinder bore, first, second and third crankcase ports communicating with the crankcase portion, and first, second and third transfer passages communicating respectively between the first, second and third crankcase ports and the first-mentioned, second and third inlet ports.

In one embodiment, the crankcase portion is located in the pattern lower portion, and each of the crankcase ports has a lower portion located in the pattern lower portion, and an upper portion located in the pattern middle portion and aligned with the crankcase port lower portion.

In one embodiment, the pattern middle portion has a lower surface, the crankcase portion is located in the pattern lower portion, the crankcase ports are located in the pattern lower portion and have upper edges defined by the lower surface of the pattern middle portion, and the transfer passages are located in the upper, middle and lower pattern portions.

In one embodiment, the foam mold pattern further includes an exterior, and an exhaust passage communicating between the exhaust port and the exterior.

In one embodiment, the exhaust passage has an upper portion located in the pattern upper portion, and a lower portion located in the pattern middle portion.

In one embodiment, the exhaust passage has an upper portion located in the pattern upper portion, a middle portion located in the pattern middle portion, and a lower portion located in the pattern lower portion.

In one embodiment, the foam mold pattern further includes an exterior, and a cooling passage communicating with the exterior.

In one embodiment, the cooling passage has an upper portion located in the pattern upper portion, a middle portion located in the pattern middle portion, and a lower portion located in the pattern lower portion.

The invention also provides a method of fabricating a foam mold pattern for making an engine block in a lost foam casting process, the method comprising the steps of: fabricating a pattern first portion including a cylinder wall defining a first portion of a cylinder bore, and a first portion of a port in the cylinder wall communicating with the cylinder bore, fabricating a pattern second portion including a second portion of the cylinder bore, and attaching the pattern second portion to the pattern first portion with the cylinder bore second portion in alignment with the cylinder bore first portion.

In one embodiment, the first fabricating step includes the steps of providing a mold comprising a plurality of pieces forming a cavity having the shape of the pattern first portion, one of the pieces including a portion for forming the first portion of the port, and injecting foam particles into the mold to fill the cavity.

The invention also provides a method of fabricating a foam mold pattern for making an engine block in a lost foam casting process, the method comprising said steps of: fabricating a pattern upper portion including a cylinder bore upper portion, and an upper portion of an exhaust port and an upper portion of an inlet port communicating with the cylinder bore upper portion, fabricating a pattern middle portion including a cylinder bore middle portion, a lower portion of an exhaust port, a lower portion of an inlet port, and an upper portion of a crankcase port communicating with the cylinder bore middle portion, fabricating a pattern lower portion including a cylinder bore lower portion, a crankcase portion, and a lower portion of a crankcase port communicating with the cylinder bore lower portion, attaching the pattern middle portion to the pattern upper portion such that the cylinder bore middle portion is aligned with the cylinder bore upper portion, the exhaust port lower portion is aligned with the exhaust port upper portion, and the inlet port lower portion is aligned with the inlet port upper portion, and attaching the pattern lower portion to the pattern upper portion such that the cylinder bore lower portion is aligned with the cylinder bore upper portion, and the crankcase port lower portion is aligned with the crankcase portion upper portion.

A principal feature of the invention is the provision of a foam pattern for a two cycle cylinder block comprising a plurality of pieces glued together, each of the pieces having a structure such that the piece can be formed by conventional injection molding processes, without the use of movable cores. More particularly, the cylinder block pattern is fabricated in three pieces which are the equivalent of the completed pattern divided along two parallel planes perpendicular to the longitudinal axes of the cylinders, with the upper plane dividing each of the exhaust port and the inlet ports, and with the lower plane dividing each of the crankcase ports. Thus, the molding of each of the pieces can be done without the need to form a complete port in the wall of a cylinder bore. This greatly simplifies the injection molding process.

Another principal feature of the invention is the provision of a foam pattern comprising an upper portion including a cylinder bore upper portion, an upper portion of an exhaust port, and an upper portion of an inlet port. The positioning of the upper edges of these ports is important. If the upper edges of the ports do not line up exactly with the upper edges of the corresponding openings in the cylinder liner, which is produced separately, turbulence and a loss of engine efficiency will result. Having the upper edges of all of the ports in one piece avoids improper positioning due to the build up of production tolerances when two pieces are connected.

Other features and advantages of the invention will become apparent to those skilled in the art upon review of the following detailed description, claims, and drawings.

Figure 2:
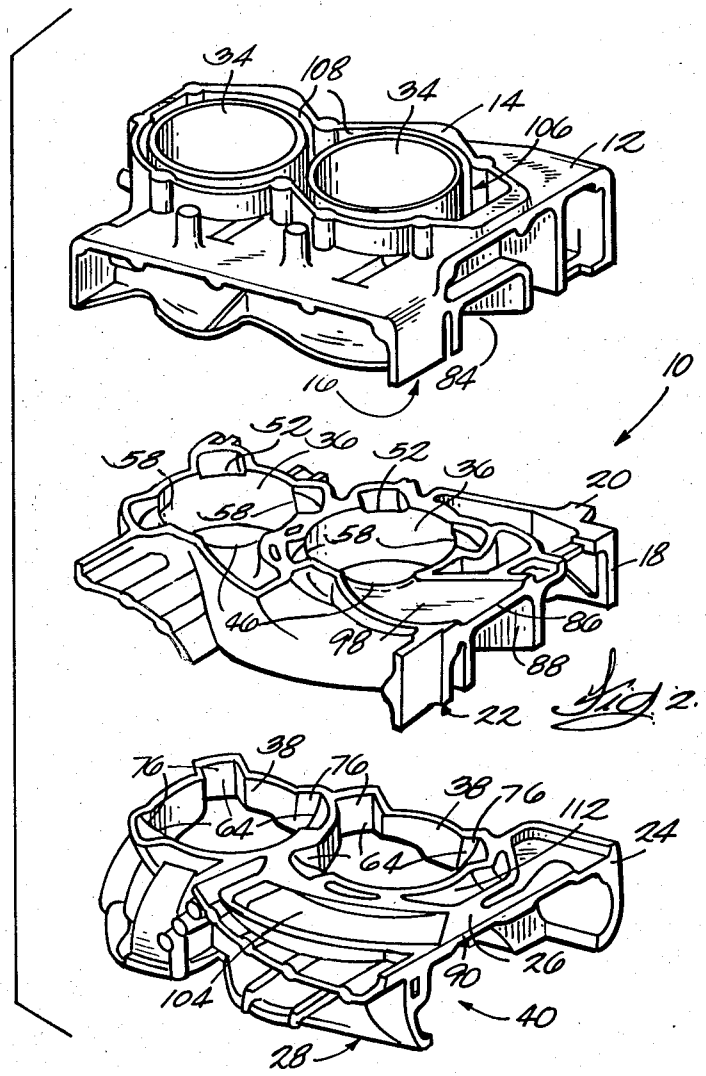
FIG. 2 is an exploded view of the foam pattern.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A foam mold pattern 10 embodying the invention is illustrated in the drawings. The assembled pattern 10 is illustrated in FIGS. 1 and 6 through 8, and the three portions of the pattern 10 are illustrated in FIGS. 2 through 5. While it is to be understood that the pattern is not a cylinder block, but rather a foam pattern having structure identical to a cylinder block to be made therewith, the pattern will be described using the terminology that would be used in describing a cylinder block. For example, a passage in the pattern that corresponds to an exhaust passage of the cylinder block will be referred to as the exhaust passage of the pattern.

As best shown in FIGS. 2 through 5, the pattern 10 comprises an upper portion 12 having a generally flat upper surface 14, and a generally flat lower surface 16 parallel to the upper surface 14. The pattern 10 also comprises a middle portion 18 including a generally flat upper surface 20 attached to the lower surface 16 of the upper portion 12, and a generally flat lower surface 22 parallel to the upper surface 20. The pattern 10 further comprises a lower portion 24 having a generally flat upper surface 26 attached to the lower surface 22 of the middle portion 18, and a generally flat lower surface 28 parallel to the upper surface 26.

The pattern 10 includes a pair of cylinder walls defining a pair of generally parallel cylinder bores 30 and 32 (FIGS. 1 and 6) extending generally perpendicular to the upper surface 14. The cylinder bores 30 and 32 are substantially identical, and only the cylinder bore 30 is described in detail. Features of the cylinder bore 32 in common with the features of the cylinder bore 30 are given the same reference numerals.

As best shown in FIG. 2, the cylinder bore 30 includes an upper portion 34 located in and extending through the pattern upper portion 12, a middle portion 36 located in and extending through the pattern middle portion 18, and a lower portion 38 located in the pattern lower portion 24. The cylinder bore 30 has upper and lower ends located in the pattern upper and lower portions 12 and 24, respectively.

The pattern 10 further includes a crankcase portion 40 (FIGS. 1, 2, and 5) located in the pattern lower portion 24 and communicating with the lower end of the cylinder bore 30 or the cylinder bore lower portion 38. In the preferred embodiment, the pattern lower portion 24 forms the upper half of a crankcase housing which defines the upper half of a crankcase. Thus, the cylinder block formed by the pattern 10 is adapted to have the lower half of a crankcase housing connected thereto in order to form a complete crankcase.

Figure 7:
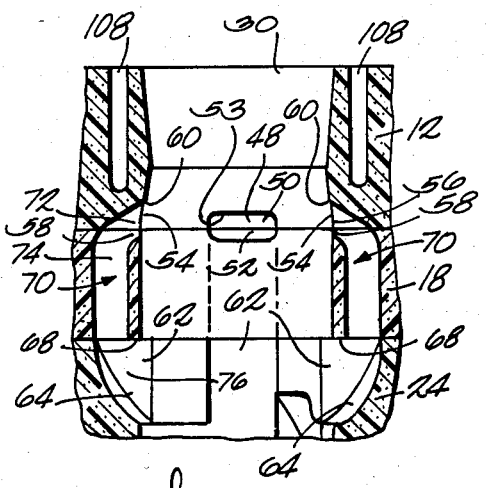
FIG. 7 is a cross-sectional view taken along line 7—7 in FIG. 6.
Figure 8:
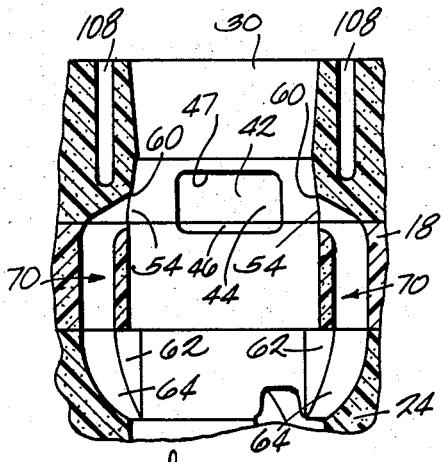
FIG. 8 is a cross-sectional view taken along line 8—8 in FIG. 6.

The pattern 10 further includes an exhaust port 42 (FIG. 8) in the cylinder wall and having an upper portion 44 (FIG. 3) in the pattern upper portion 12, and a lower portion 46 (FIG. 2) in the pattern middle portion 18. The exhaust port 42 is generally rectangular, as best shown in FIG. 8, and has a generally linear upper edge 47 located in the pattern upper portion 12. The pattern further 10 includes an inlet port 48 (FIG. 7) in the cylinder wall and having an upper portion 50 (FIG. 3) in the pattern upper portion 12, and a lower portion 52 (FIG. 2) in the pattern middle portion 18. The inlet port 48 is also generally rectangular and has a generally linear upper edge 53 (FIG. 7) in the pattern upper portion 12.

In the preferred embodiment, the cylinder block formed by the pattern 10 is a loop scavenged cylinder block with a boost port. Accordingly, the inlet port 48 is located diametrically opposite the exhaust port 42 and is more specifically known as a boost port. The pattern 10 further includes second and third inlet ports or scavenging ports 54 in the cylinder wall, as best shown in FIGS. 7 and 8. The inlet ports 54 are located generally opposite one another and each includes an upper portion 56 (FIG. 3) in the pattern upper portion 12, and a lower portion 58 (FIG. 2) in the pattern middle portion 18. More particularly, each of the inlet ports 54 is generally rectangular and has a generally linear upper edge 60 (FIGS. 7 and 8) in the pattern upper portion 12.

As is known in the art, the upper edge 47 of the exhaust port 42 is spaced closest to the upper end of the cylinder bore 30 so that during the downstroke of the piston (not shown) the exhaust port opens before the inlet ports open. Furthermore, the upper edge 53 of the first inlet port or boost port 48 is spaced farther from the upper end of the cylinder 30 than are the upper edges 60 of the second and third inlet ports or scavenging ports 54.

The pattern 10 further includes three crankcase ports 62 (FIGS. 7 and 8) located at the lower end of the cylinder bore 30 and communicating with the crankcase portion 40. In the preferred embodiment, each of the crankcase ports 62 has a lower portion 64 (FIG. 2) in the pattern lower portion 24, and an upper portion in the pattern middle portion 18. More particularly, each of the crankcase ports 62 is located in the pattern lower portion 24 except for an upper edge 68 (FIG. 4) defined by the lower surface 22 of the pattern middle portion 18.

The pattern 10 further includes three transfer passages 70 (FIGS. 7 and 8) communicating between the crankcase ports 62 and the inlet ports 48 and 54. Each of the transfer passages 70 has an upper portion 72 (FIG. 3) in the pattern upper portion 12, a middle portion 74 (FIG. 4) in the pattern middle portion 18, and a lower portion 76 (FIG. 2) in the pattern lower portion 24.

Figure 1:
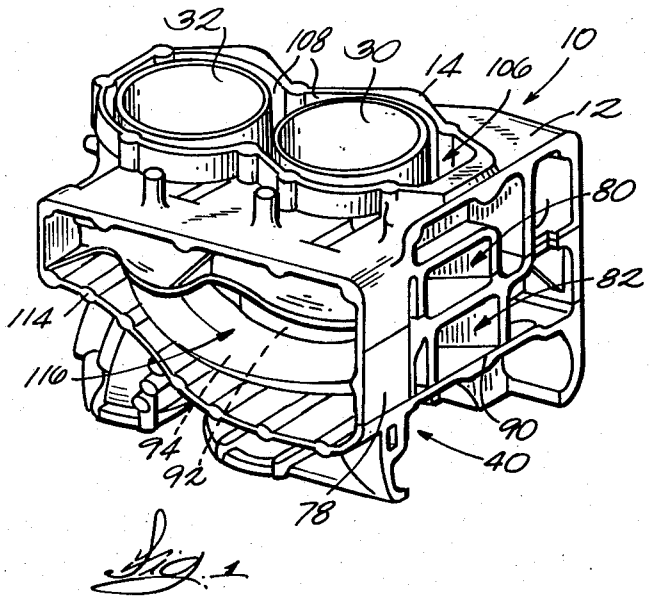
FIG. 1 is a perspective view of an assembled foam mold pattern embodying the invention.
Figure 3:
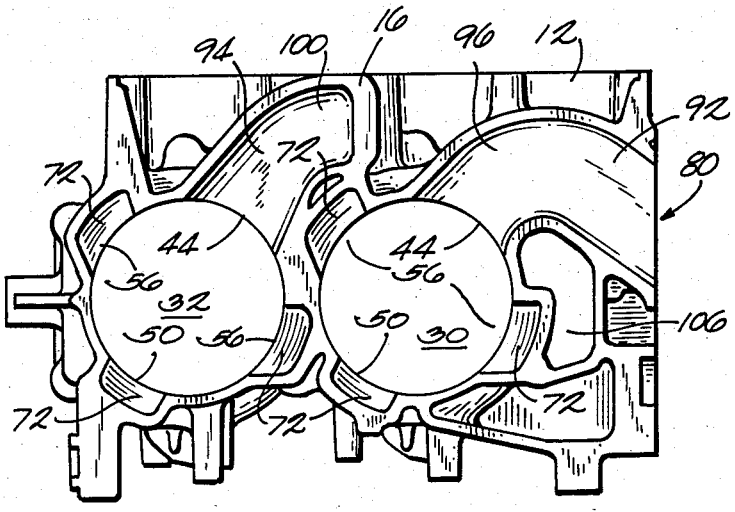
FIG. 3 is a bottom view of the upper portion of the pattern.
Figure 4:
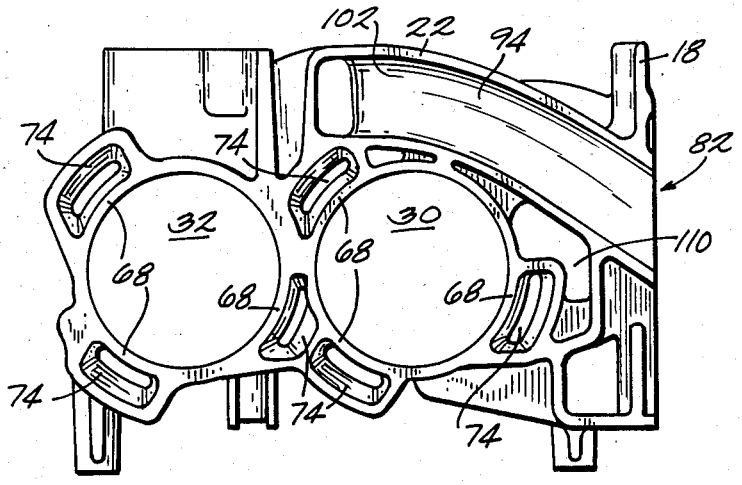
FIG. 4 is a bottom view of the middle portion of the pattern.
Figure 5:
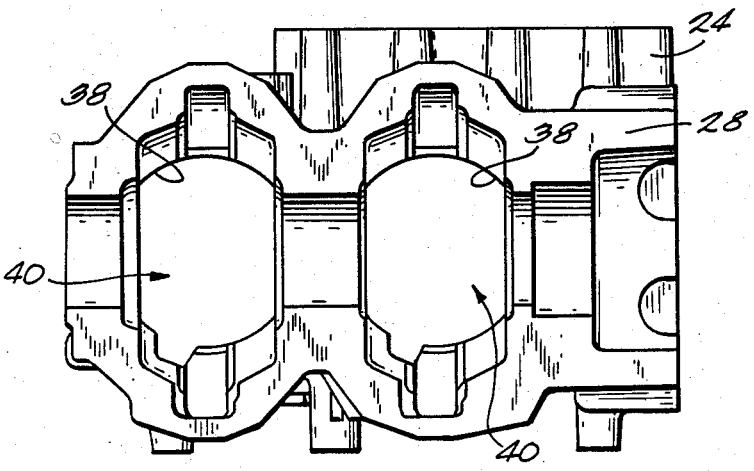
FIG. 5 is a bottom view of the lower portion of the pattern.
Figure 6:
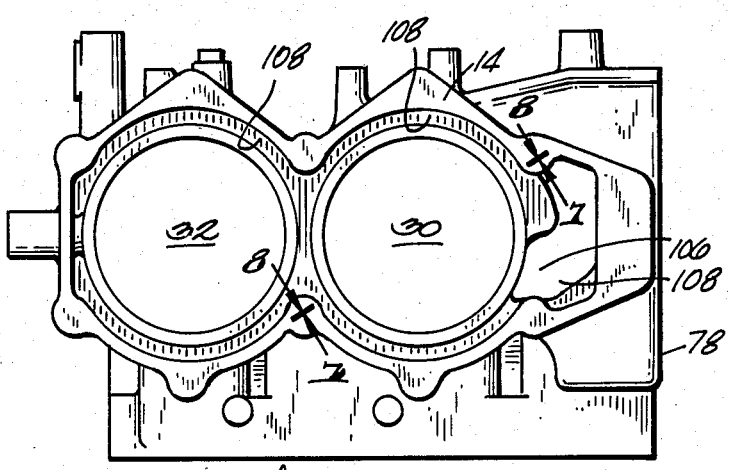
FIG. 6 is a top view of the pattern.

As best shown in FIGS. 1 and 6, the pattern 10 has an end surface 78 generally parallel to the cylinder bores 30 and 32, a first or upper exhaust opening 80 (FIG. 1) in the end surface 78, and a second or lower exhaust opening 82 (FIG. 1) in the end surface 78 beneath the first exhaust opening 80. In the illustrated construction, the upper exhaust opening 80 has an upper portion 84 (FIG. 2) in the pattern upper portion 12, and a lower portion 86 (FIG. 2) in the pattern middle portion 18. The lower exhaust opening 82 has an upper portion 88 (FIG. 2) in the pattern middle portion 18, and a lower edge 90 (FIGS. 1 and 2) defined by the upper surface 26 of the pattern lower portion 24.

The pattern 10 further includes a first exhaust passage 92 (FIG. 3) communicating between the exhaust port of the first cylinder bore 30 and the upper exhaust opening 80, and a second exhaust passage 94 (FIGS. 3 and 4) communicating between the exhaust port of the second cylinder bore 32 and the lower exhaust opening 82. The first exhaust passage 92 has an upper portion 96 (FIG. 3) in the pattern upper portion 12, and a lower portion 98 (FIG. 2) in the pattern middle portion 18. The second exhaust passage 94 extends beneath the first exhaust passage 92 and has an upper portion 100 (FIG. 3) in the pattern upper portion 12, a middle portion 102 (FIG. 4) in the pattern middle portion 18, and a lower portion 104 (FIG. 2) in the pattern lower portion 24.

The pattern 10 further includes a cooling passage 106 (FIGS. 1 and 2) including an upper portion 108 in the pattern upper portion 12. As best shown in FIG. 6, the cooling passage upper portion 108 includes a portion extending around both of the cylinder bore upper portions 34. The cooling passage 106 further includes a middle portion 110 (FIG. 4) in the pattern middle portion 18, and a lower portion 112 (FIG. 2) in the pattern lower portion 24. As best shown in FIG. 1, the pattern 10 further includes wall means 114 (FIG. 1) defining a portion of a water chamber 116 adjacent the exhaust passages 92 and 94. The cylinder block formed by the pattern 10 is adapted to have a water cover (not shown) attached to the wall means 114 in order to close the water chamber 116. In an alternative embodiment, the pattern 10 can further include the water cover (not shown). The water chamber 116 communicates with the cooling passage upper portion 108 via apertures (not shown) in the pattern upper portion 12.

While it is to be understood that the completed pattern 10 is formed by assembling the individually fabricated upper, middle, and lower portions, 12, 18, and 24, respectively, it will be instructive in understanding the three portions of the pattern 10 to view them as if they were formed by separating the completed pattern into three pieces. If such were the case, the three portions of the pattern 10 would be formed by cutting the completed pattern along two planes parallel to the upper surface 14 of the pattern 10. The upper plane would divide the upper and middle portions 12 and 18 and would cut through each of the exhaust ports 42, the inlet ports 48 and 54, the exhaust passages 92 and 94, the upper exhaust opening 80, and the cooling passage 106. Thus, each of these has a portion in the pattern upper portion 12 and a portion in the pattern middle portion 18. The lower plane would divide the middle and lower portions 18 and 24 and would cut through each of the crankcase ports 62, the lower exhaust passage 94, and the lower exhaust opening 82. Thus, each of these has a portion in the pattern middle portion 18, and a portion in the pattern lower portion 24. The location of these cuts is important, as it simplifies fabrication of the portions of the foam pattern 10, as explained previously.

Figure 9:
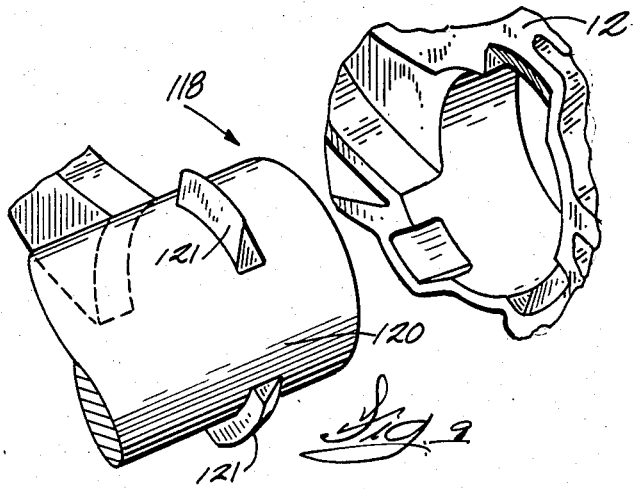
FIG. 9 is a partial, perspective view of a piece of a mold used in fabricating the upper portion of the pattern.

The individual portions of the foam pattern 10 can be formed by any suitable method. The preferred method is to fabricate the pattern portions by injection molding. Preferably, the pattern upper portion 12 is fabricated by providing a mold 118 (shown partially in FIG. 9) comprising a plurality of pieces forming a cavity having the shape of the pattern upper portion 12, with one of the pieces 120 including portions 121 for forming the upper portions of each of the inlet ports 48 and 54 and the exhaust port 42. By having the portions 121 of the mold 118 forming the upper edges of all of the ports in one piece of the mold, inexact spacing of the upper edges due to the build up of tolerances is substantially avoided. Exact spacing of the upper edges of the ports is important, as explained previously. Fabrication of the pattern upper portion 12 is completed by injecting foam particles into the mold 118 to fill the cavity, as is known in the injection molding art.

In accordance with the method of the invention, the pattern 10 is assembled by attaching the upper surface 20 of the pattern middle portion 18 to the lower surface 16 of the pattern upper portion 12 such that the cylinder bore middle portion 36 is aligned with the cylinder bore upper portion 34, the exhaust port lower portion 46 is aligned with the exhaust port upper portion 44, the inlet port lower portions 52 and 58 are aligned with the inlet port upper portions 50 and 56, the upper exhaust passage lower portion 98 is aligned with the upper exhaust passage upper portion 96, the lower exhaust passage middle portion 102 is aligned with the lower exhaust passage upper portion 100, the cooling passage middle portion 110 is aligned with the cooling passage upper portion 108, and the upper exhaust opening lower portion 86 is aligned with the upper exhaust opening upper portion 84.

Also, the upper surface 26 of the pattern lower portion 24 is attached to the lower surface 22 of the pattern middle portion 18 such that the cylinder bore lower portion 38 is aligned with the cylinder bore middle portion 36, the crankcase port lower portion 64 is aligned with the crankcase port upper edge 68, the lower exhaust passage lower portion 104 is aligned with the lower exhaust passage middle portion 102, the cooling passage lower portion 112 is aligned with the cooling passage middle portion 110, and the lower exhaust opening lower edge 90 is aligned with the lower exhaust opening upper portion 88.

In the alternative embodiment wherein the foam pattern 10 further includes the water cover, assembly can be completed by attaching the water cover to the wall means 114, or the water cover can be fabricated in three portions along with the three portions of the pattern 10.

In the preferred embodiment, the foam pattern portions are attached by gluing the portions together, as is well known in the art.

Various features and advantages of the invention are set forth in the following claims.

We claim:

1. A foam mold pattern for making an engine block in a lost foam casting process, said pattern comprising a first portion including a cylinder wall defining a first portion of a cylinder bore, and a first portion of a port located in said cylinder wall and communicating with said cylinder bore, and a second portion including a second portion of said cylinder bore and being attached to said pattern first portion with said second portion of said cylinder bore in alignment with said first portion of said cylinder bore.

2. A foam mold pattern as set forth in claim 1 wherein said pattern second portion further includes a second portion of said port communicating with said cylinder bore and aligned with said port first portion.

3. A foam mold pattern for making an engine block in a lost foam casting process, said pattern comprising an upper portion including a cylinder bore upper portion, an upper portion of an exhaust port communicating with said cylinder bore upper portion, and an upper portion of an inlet port communicating with said cylinder bore upper portion, a middle portion including a cylinder bore middle portion and being attached to said pattern upper portion with said cylinder bore middle portion in alignment with said cylinder bore upper portion, and a lower portion including a cylinder bore lower portion and being attached to said pattern middle portion with said cylinder bore lower portion in alignment with said cylinder bore middle portion.

4. A foam mold pattern as set forth in claim 3 wherein said pattern middle portion further includes a lower portion of an exhaust port communicating with said cylinder bore middle portion and aligned with said exhaust port upper portion, and a lower portion of an inlet port communicating with said cylinder bore middle portion and aligned with said inlet port upper portion.

5. A foam mold pattern as set forth in claim 3 wherein said inlet port upper portion has an upper edge located in said pattern upper portion and is positioned radially opposite said exhaust port, wherein said cylinder bore has an upper end, and wherein said pattern further includes second and third inlet ports communicating with said cylinder bore and having upper portions located in said pattern upper portion and having upper edges equidistant from said upper end of said cylinder bore, said upper edge of said first-mentioned inlet port being spaced farther from said upper end of said cylinder bore than are said upper edges of said second and third inlet ports.

6. A foam mold pattern as set forth in claim 5 wherein each of said first-mentioned, second and third inlet ports also has a lower portion located in said pattern middle portion.

7. A foam mold pattern as set forth in claim 3 wherein said cylinder bore has a lower end, and wherein said pattern further includes a portion of a crankcase communicating with said lower end of said cylinder bore, first, second and third crankcase ports communicating with said crankcase portion, and first, second and third transfer passages communicating respectively between said first, second and third crankcase ports and said first-mentioned, second and third inlet ports.

8. A foam mold pattern as set forth in claim 7 wherein said crankcase portion is located in said pattern lower portion, and wherein each of said crankcase ports has a lower portion located in said pattern lower portion, and an upper portion located in said pattern middle portion and aligned with said crankcase port lower portion.

9. A foam mold pattern as set forth in claim 7 wherein said pattern middle portion has a lower surface, wherein said crankcase portion is located in said pattern lower portion, wherein said crankcase ports are located in said pattern lower portion and have upper edges defined by said lower surface of said pattern middle portion, and wherein said transfer passages are located in said upper, middle and lower pattern portions.

10. A foam mold pattern as set forth in claim 3 and further including an exterior, and an exhaust passage communicating between said exhaust port and said exterior.

11. A foam mold pattern as set forth in claim 10 wherein said exhaust passage has an upper portion located in said pattern upper portion, and a lower portion located in said pattern middle portion.

12. A foam mold pattern as set forth in claim 10 wherein said exhaust passage has an upper portion located in said pattern upper portion, a middle portion located in said pattern middle portion, and a lower portion located in said pattern lower portion.

13. A foam mold pattern as set forth in claim 3 and further including an exterior, and a cooling passage communicating with said exterior.

14. A foam mold pattern as set forth in claim 13 wherein said cooling passage has an upper portion located in said pattern upper portion, a middle portion located in said pattern middle portion, and a lower portion located in said pattern lower portion.

15. A foam mold pattern as set forth in claim 3 wherein said exhaust port also has a lower portion located in said pattern middle portion.

16. A foam mold pattern as set forth in claim 3 wherein said inlet port also has a lower portion located in said pattern middle portion.

17. A foam mold pattern for making an engine block in a lost foam casting process, said pattern comprising an upper portion, a middle portion attached to said upper portion, and a lower portion attached to said middle portion, and said foam mold pattern including an exterior, a first cylinder wall defining a first cylinder bore having an upper portion located in said pattern upper portion, a middle portion aligned with said first cylinder bore upper portion and located in said pattern middle portion, and a lower portion aligned with said first cylinder bore middle portion and located in said pattern lower portion, a second cylinder wall defining a second cylinder bore parallel to said first cylinder bore and having an upper portion located in said pattern upper portion, a middle portion aligned with said second cylinder bore upper portion and located in said pattern middle portion, and a lower portion aligned with said second cylinder bore middle portion and located in said pattern lower portion, a first exhaust port in said first cylinder wall communicating with said first cylinder bore and having an upper edge located in said pattern upper portion, a second exhaust port in said second cylinder wall communicating with said second cylinder bore and having an upper edge located in said pattern upper portion, a first inlet port in said first cylinder wall communicating with said first cylinder bore and having an upper edge loated in said pattern upper portion, a second inlet port in said second cylinder wall communicating with said second cylinder bore and having an upper edge located in said pattern upper portion, a first exhaust passage communicating between said first exhaust port and said exterior, and a second exhaust passage communicating between said second exhaust port and said exterior.

18. A foam mold pattern as set forth in claim 17 wherein said first exhaust passage has an upper portion located in said pattern upper portion, and a lower portion located in said pattern middle portion, and wherein said second exhaust passage has an upper portion located in said pattern upper portion, a middle portion located in said pattern middle portion, and a lower portion located in said pattern lower portion.

19. A foam mold pattern as set forth in claim 17 and further including an end surface generally parallel to said cylinder bores, a first exhaust opening in said end surface, and a second exhaust opening in said end surface beneath said first exhaust opening, wherein said first exhaust passage communicates between said first exhaust port and said first exhaust opening, and said second exhaust passage communicates between said second exhaust port and said second exhaust opening.

20. A foam mold pattern as set forth in claim 19 wherein said pattern lower portion has an upper surface, wherein said first exhaust opening has an upper portion in said pattern upper portion, and a lower portion in said pattern middle portion, and wherein said second exhaust opening has an upper portion in said pattern middle portion, and a lower edge defined by said upper surface of said pattern lower portion.

21. A foam mold pattern as set forth in claim 20 wherein said first exhaust passage has an upper portion located in said pattern upper portion, and a lower portion located in said pattern middle portion, and wherein said second exhaust passage has an upper portion located in said pattern upper portion, a middle portion located in said pattern middle portion, and a lower portion located in said pattern lower portion.

22. A method of fabricating a foam mold pattern for making an engine block in a lost foam casting process, said method comprising the steps of: fabricating a pattern first portion including a cylinder wall defining a first portion of a cylinder bore, and a first portion of a port in said cylinder wall communicating with said cylinder bore, fabricating a pattern second portion including a second portion of said cylinder bore, and attaching said pattern second portion to said pattern first portion with said cylinder bore second portion in alignment with said cylinder bore first portion.

23. A method as set forth in claim 22 wherein said first fabricating step includes the steps of providing a mold comprising a plurality of pieces forming a cavity having the shape of said pattern first portion, one of said pieces including a portion for forming said first portion of said port, and injecting foam particles into said mold to fill said cavity.

24. A method of fabricating a foam mold pattern for making an engine block in a lost foam casting process, said method comprising the steps of: fabricating a pattern upper portion including a cylinder bore upper portion, and an upper portion of an exhaust port and an upper portion of an inlet port communicating with said cylinder bore upper portion, fabricating a pattern middle portion including a cylinder bore middle portion, a lower portion of an exhaust port, a lower portion of an inlet port, and an upper portion of a crankcase port communicating with said cylinder bore middle portion, fabricating a pattern lower portion including a cylinder bore lower portion, a crankcase portion, and a lower portion of a crankcase port communicating with said cylinder bore lower portion, attaching said pattern middle portion to said pattern upper portion such that said cylinder bore middle portion is aligned with said cylinder bore upper portion, said exhaust port lower portion is aligned with said exhaust port upper portion, and said inlet port lower portion is aligned with said inlet port upper portion, and attaching said pattern lower portion to said pattern upper portion such that said cylinder bore lower portion is aligned with said cylinder bore upper portion, and said crankcase port lower portion is aligned with said crankcase portion upper port.

25. A method as set forth in claim 24 wherein said first fabricating step includes the steps of providing a mold comprising a plurality of pieces forming a cavity having the shape of said pattern upper portion, one of said pieces including portions for forming said upper portion of said inlet port and said upper portion of said exhaust port, and injecting foam particles into said mold to fill said cavity.

* * * * *